US005189475A

United States Patent [19]

Fournia et al.

[11] Patent Number: 5,189,475

[45] Date of Patent: Feb. 23, 1993

[54] DEVELOPER MECHANISM WITH SENSOR AND NOTCHED AUGER

[75] Inventors: Peter G. Fournia; Stephen D. Cipolla, both of Penfield, N.Y.

[73] Assignee: Xerox Corporation, Stamford, Conn.

[21] Appl. No.: 749,784

[22] Filed: Aug. 26, 1991

[51] Int. Cl.[5] ..... G03G 21/00

[52] U.S. Cl. ..... 355/246; 355/260

[58] Field of Search ..... 355/203, 260, 246, 245; 118/688, 689, 690, 691, 693, 694; 430/120

[56] References Cited

U.S. PATENT DOCUMENTS 3,719,165 3/1973 Trachienberg et al. .
4,141,645 2/1979 Reid et al. .
4,155,638 5/1979 Blitzer .
4,210,864 7/1980 Miyakawa et al. .
4,241,696 12/1980 Huzii .
4,577,587 3/1986 Kamezaki ..... 355/245 X
4,589,762 5/1986 De Schamphelaere et al. .
4,682,874 7/1987 Fantuzzo .
4,980,727 12/1990 Stelter ..... 355/245 X
5,005,517 4/1991 Fukui et al. ..... 118/689
5,006,896 4/1991 Koichi et al. .

*Primary Examiner*—A. T. Grimley
*Assistant Examiner*—Shuk Y. Lee
*Attorney, Agent, or Firm*—Oliff & Berridge

[57] ABSTRACT

A toner concentration sensor is located adjacent a transport auger within the developer sump. The toner concentration sensor projects from the bottom wall of the developer sump towards the transport auger to an extent that the sensor overlaps with the blade of the auger. A portion of the auger blade is notched to avoid contact between the auger blade and toner concentration sensor. The position of the sensor allows for accurate toner concentration sensing due to the active flow of toner material across the surface of the sensor.

16 Claims, 5 Drawing Sheets

DEVELOPER MECHANISM WITH SENSOR AND NOTCHED AUGER

BACKGROUND OF THE INVENTION

This invention relates generally to an electrophotographic printing machine, and more particularly concerns an apparatus for controlling dispensing of marking particles into a developer unit.

In a typical electrophotographic printing process, a photoconductive member is sensitized by charging its surface to a substantially uniform potential. The charged portion of the photoconductive member is exposed to light image of an original document being reproduced. Exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to copy sheet. The toner particles are heated to permanently affix the powder image to the copy sheet.

It is generally well known that the density or concentration of toner particles has to be maintained within an appropriate range in order to continuously obtain copies having a desired density. However, toner particles are being continuously depleted from the developer material as copies are being formed. Many types of systems have been developed for detecting the concentration of toner particles in the developer material. For example, a test patch recorded on the photoconductive surface is developed to form a solid area of developer material. Generally, the density of the developer material developed on the test patch is monitored by an infrared densitometer. The density of the developed test patch, as measured by the infrared densitometer, is compared to a reference level. The resulting error is detected by a control system that regulates the dispensing of toner particles from a storage container.

However, such a system used to replenish toner particles into the developer material is fairly inaccurate since the infrared densitometer is remote from the developer system. As a result, the amount of toner particles actually dispensed fluctuates around the average value set by the control system. Accordingly, accurate toner particle concentration will not reduce the control bandwidth. One of the major causes of the wide control bandwidth is the delay built into the control loop. The control loop detects low toner particle concentration after this condition has been reached and does not anticipate the requirement to furnish additional toner particlesbefore the low toner particle concentration condition is reached. In addition, added toner particles have to be mixed with the developer material and charged to the appropriate level. Mixing and charging of the toner particles requires time in addition to time required to develop the test patch.

It is also known to divert developer material to a hopper in which a toner concentration sensor is mounted. Such hopper designs, however, require additional space for the hopper and for transporting developer to the hopper, such that the size, cost, material flow time, and torque of the developer assembly are increased.

It is further known that a toner concentration sensor device, comprised in part, of a transformer with a magnetic core, can be mounted in the developer material. Such a device must be placed in the active developer material flow so as to measure the developer material which is actively transported to the developer roll. However, developer transported by augers is prone to shear at the outer most edge of the auger blade, especially at high humidities, so as to not freely flow over the surface of the toner concentration sensor. This results in a sensing inaccuracy and subsequent wide and biased toner concentration control band.

SUMMARY OF THE INVENTION

It is an object of the present invention to provide a toner dispenser control with decreased response time and improved accuracy.

It is another object of the present invention to provide a sensor for sensing the concentration of toner particles in the developer sump adjacent one of the transport augers in the developer sump.

It is still another object of the present invention to provide a toner concentration sensor immediately below a transport auger for detecting toner concentration as the toner moves past the sensor due to the rotation of the auger.

It is yet another object of the present invention to provide a sensor below a transport auger, the sensor projecting past the blade of the auger, the auger blade having a notched portion above the sensor for avoiding contact with the sensor.

These and other objects of the present invention are accomplished by a developer mechanism and method for determining a concentration of toner particles within a two-component development printing machine in which two-component developer material comprises the toner particles and carrier granules in a reservoir, the toner particles being selectively attracted to a charged receptor surface. The invention utilizes at least one auger for transporting the developer material in the reservoir by rotation of at least one auger therein, the auger comprising a blade extending from its central core. An amount of toner particles is sensed by a sensor in the reservoir, the sensor mounted adjacent to the at least one auger. The sensor detects a signal corresponding to, at least in part, the amount of toner particles. The sensor is positioned to project from a wall of the reservoir to overlap with the radially extending blade of the auger. The blade of the auger has a notched portion above the sensor to avoid contact with said sensor during rotation of the auger.

Developer material within the diameter of the auger blades is transported by the auger by force from the auger blade. However, shear of the developer material at the outer edge of the auger blade usually occurs particularly in high humidity environments, resulting in poor or no transport of developer material outside of the auger blade diameter. Consequently, a sensor positioned wholely outside of the auger blade diameter does not sense actively transported material and thus does not sense accurately. Because of the overlap of the projecting sensor with the radially extending blade of the auger in the present invention, the sensor is positioned within the continuous flow path of the developer material moved along by the rotating auger.

BRIEF DESCRIPTION OF THE DRAWINGS

The foregoing and other objects, features and advantages of the invention will be apparent in the following more detailed description of preferred embodiments of the invention in connection with accompanying drawings wherein.

DETAILED DESCRIPTION OF THE PREFERRED EMBODIMENTS

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

Figure 1:
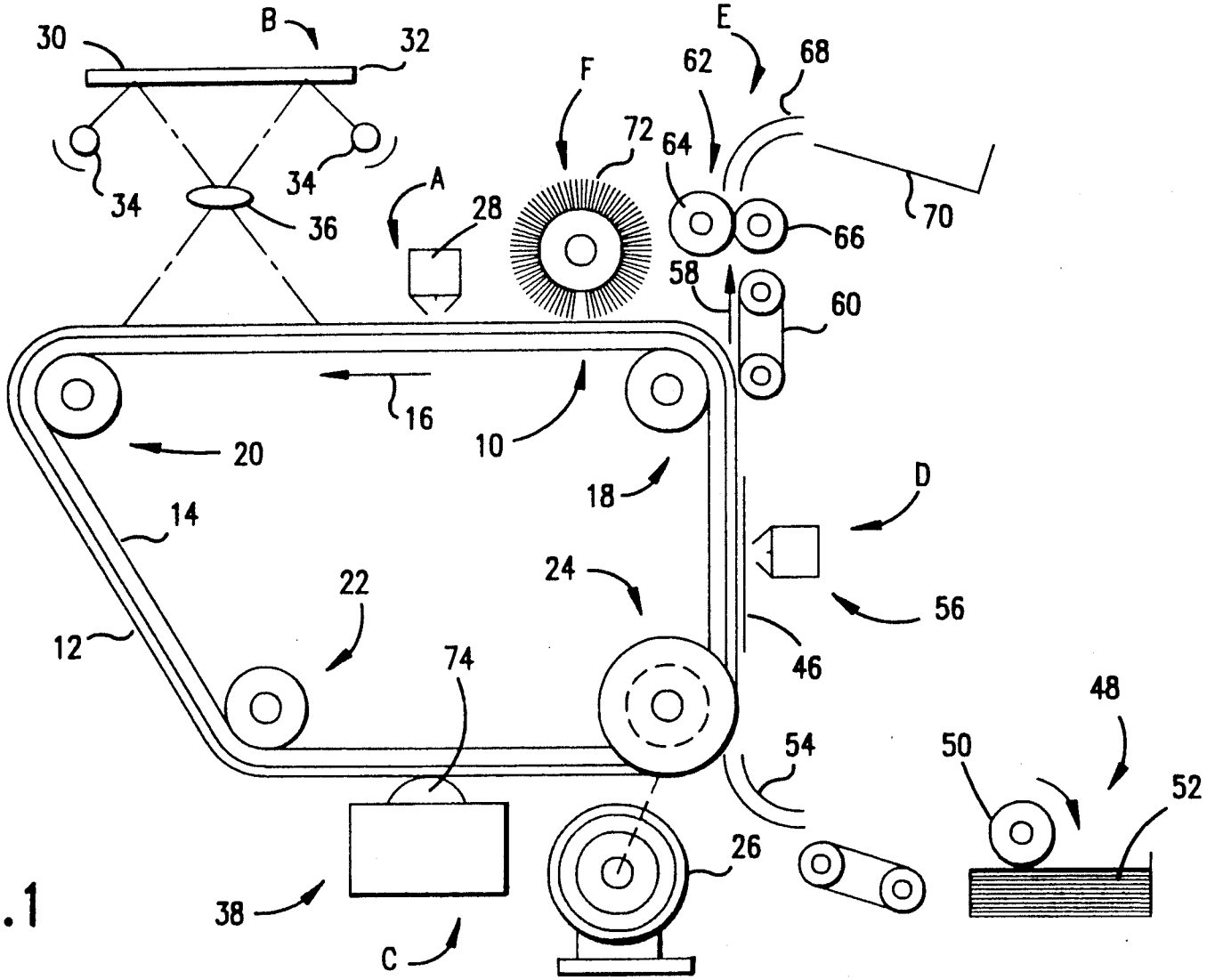
FIG. 1 is a schematic elevational view depicting an electrophotographic printing machine incorporating the toner concentration controller of the present invention.

For a general understanding of the features of the present invention, reference is made to the drawings. In the drawings, like reference numerals have been used throughout to designate identical elements. FIG. 1 schematically depicts the various elements of an illustrative electrophotographic printing machine incorporating the toner concentration control of the present invention therein. It will become evident from the following discussion that this toner concentration control is equally well suited for use in a wide variety of printing machines and is not necessarily limited in its application to the particular embodiment depicted herein.

1. Electrophotographic Printing Using Toner Concentration Control

Inasmuch as the art of electrophotographic printing is well known, the various processing stations employed in the FIG. 1 printing machine will be shown hereinafter schematically and their operation described briefly with reference thereto.

Turning now to FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy which is electrically grounded. Other suitable photoconductive surfaces and conductive substrates may also be employed. Belt 10 moves in the direction of arrow 16 to advance successive portions of photoconductive surface 12 through the various processing stations disposed about the path of movement thereof. As shown, belt 10 is entrained about rollers 18, 20, 22 and 24. Roller 24 is coupled to motor 26 which drives roller 24 so as to advance belt 10 in the direction of arrow 16. Rollers 18, 20 and 22 are idler rollers which rotate freely as belt 10 moves in the direction of arrow 16.

Initially, a portion of belt 10 passes through charging station A. At charging station A, a corona generating device, indicated generally by the reference numeral 28, charges a portion of photoconductive surface 12 of belt 10 to a relatively high, substantially uniform potential.

Next, the charged portion of photoconductive surface 12 is advanced through exposure station B. At exposure station B, an original document 30 is positioned face down upon a transparent platen 32. Lamps 34 flash light rays onto original document 30. The light rays reflected from original document 30 are transmitted through lens 36 forming a light image thereof. Lens 36 focuses the light image onto the charged portion of photoconductive surface 12 to selectively dissipate the charge thereon. This records an electrostatic latent image on photoconductive surface 12 which corresponds to informational areas contained within original document 30 disposed upon transparent plate 32. Thereafter, belt 10 advances the electrostatic latent image recorded on photoconductive surface 12 to development station C.

At development station C, a developer unit, indicated generally by the reference numeral 38, transports a two-component developer material of toner particles and carrier into contact with the electrostatic latent image recorded on photoconductive surface 12. Toner particles are attracted to the electrostatic latent image forming a toner powder image on photoconductive surface 12 of belt 10 so as to develop the electrostatic latent image.

After development, belt 10 advances the toner powder image to transfer station D. At transfer station D, a sheet of support material 46 is moved into contact with the toner powder image. Support material 46 is advanced to transfer station D by a sheet feeding apparatus, indicated generally by the reference numeral 48. Preferably, sheet feeding apparatus 48 includes a feed roll 50 contacting the upper most sheet of a stack of sheets 52. Feed roll 50 rotates to advance the upper most sheet from stack 52 into chute 54. Chute 54 directs the advancing sheet of support material 46 into contact with photoconductive surface 12 of belt 10 in a timed sequence so that the toner powder image developed thereon contacts the advancing sheet of support material at transfer station D.

Transfer station D includes a corona generating device 56 which sprays ions onto the backside of sheet 46. This attracts the toner powder image from photoconductive surface 12 to sheet 46. After transfer, the sheet continues to move in the direction of arrow 58 onto a conveyor 60 which moves the sheet to fusing station E.

Fusing station E includes a fuser assembly, indicated generally by the reference numeral 62, which permanently affixes the powder image to sheet 46. Preferably, fuser assembly 62 includes a heated fuser roller 64 and a back-up roller 66 with the toner powder image contacting fuser roller 64. In this manner, the toner powder image is permanently affixed to sheet 46. After fusing, chute 68 guides the advancing sheet to catch tray 70 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a preclean corona generating device (not shown) and a rotatably mounted fibrous brush 72 in contact with photoconductive surface 12. The pre-clean corona generator neutralizes the charge attracting the particles to the photoconductive surface. These particles are cleaned from the photoconductive surface by the rotation of brush 72 in contact therewith. Subsequent to cleaning, a discharge lamp (not shown) floods photoconductive surface 12 with light to dissipate any residual charge remaining thereon prior to the charging thereof for the next successive imaging cycle.

The foregoing description is sufficient for purposes of the present application to illustrate the general operation of an exemplary electrophotographic printing machine incorporating the features of the present invention therein.

Figure 2:
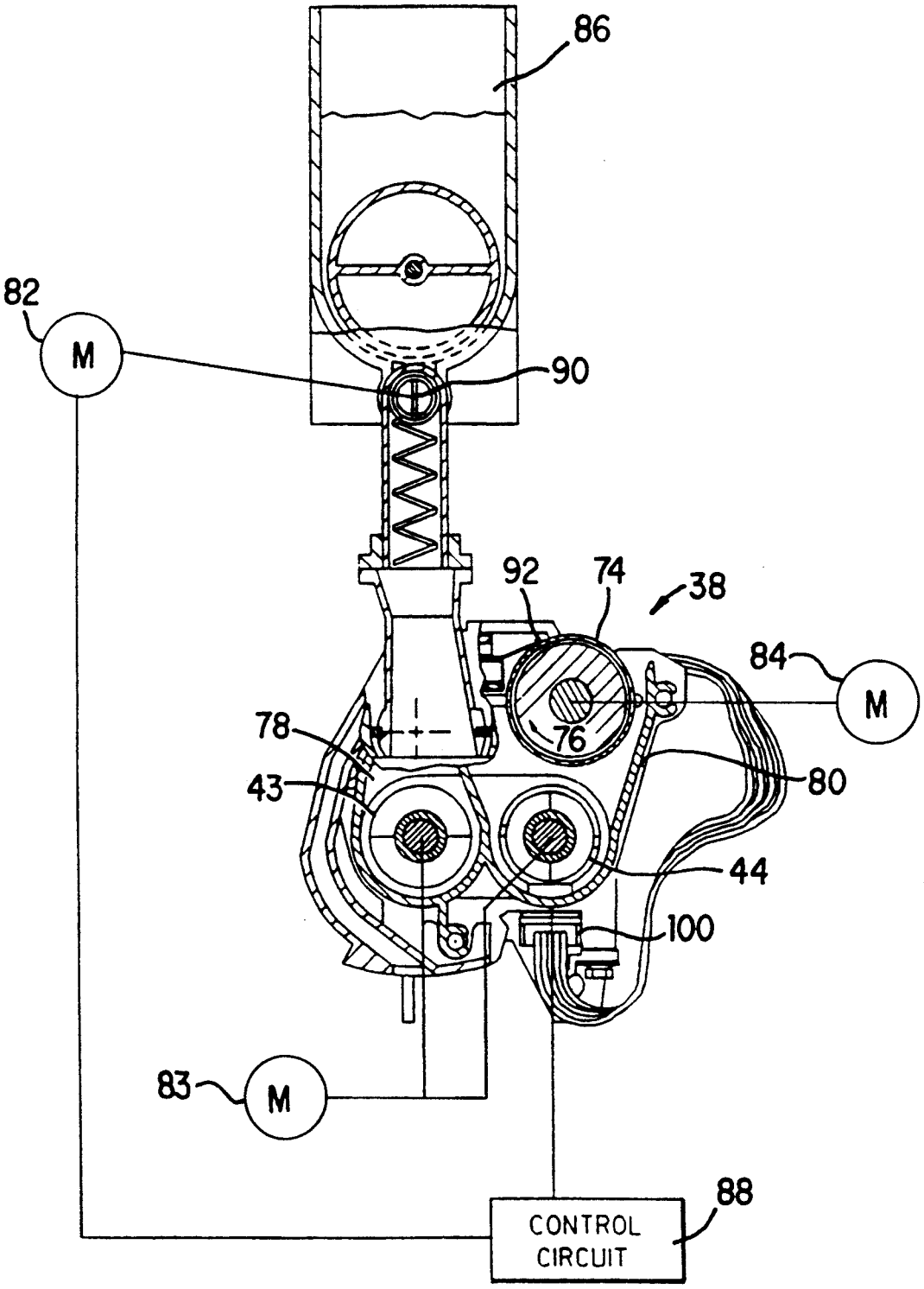
FIG. 2 is a schematic elevational view showing the development apparatus used in the FIG. 1 printing machine.

Referring now to FIG. 2, the detailed structure of developer unit 38 is shown. The developer unit includes a donor roller 74. An electrical bias is applied to the donor roller. The electrical bias applied on the donor roller depends upon the background voltage level of the photoconductive surface, the characteristics of the donor roller, and the spacing between the donor roller and the photoconductive surface. It is thus clear that the electrical bias applied on the donor roller may vary widely. Donor roller 74 is coupled to a motor 84 which rotates donor roller 74 in the direction of arrow 76. Donor roller 74 is positioned, at least partially, in chamber 78 of housing 80.

Developer material transport augers, indicated generally by the reference numerals 43, 44, mix and fluidize the toner and carrier particles and transport the material through the chamber. Inasmuch as new toner particles are being discharged from container 86 into one end of the chamber 78 of housing 80, the force exerted on the toner and carrier particles by the rotating augers moves the toner and carrier particles around chamber 78. Augers 43, 44 are located in chamber 78 closely adjacent to the bottom wall of chamber 78. New toner particles are discharged into one end of chamber 78 from container 86. As augers 43, 44 are rotated by motor 83 in the direction of arrows, toner particles move in one direction along one auger and in the opposite direction along the second auger so that toner is mixed and fluidized in a circular direction. The fluidized toner and carrier particles being moved are attracted to donor roller 74.

The concentration of the toner particles is measured by toner concentration sensor 100 located directly beneath auger 44 in a longitudinal direction beneath the auger away from the toner dispersing of the auger. The control signal from the sensor regulates via control circuit 88 the energization of motor 82. Motor 82 is connected to auger 90 located in the open end of container 86. As auger 90 rotates, it discharges toner from container 86 into chamber 78 of housing 80.

Donor roller 74 rotates in the direction of arrow 76 to move the toner particles attracted thereto into contact with the electrostatic latent image recorded on photoconductive surface 12 of belt 10. As donor roller 74 rotates in the direction of arrow 76, magnets within 74 attract developer material. Material magnetically attached to 74 is partially removed by meterbar 92 and falls back into the sump to be remixed therein. Material passing the meterbar 92 is made available to develop the latent electrostatic image on the photoreceptor. Tribo charging is a result of the mixing within the sump. Donor rollers can be made from aluminum or steel. Alternatively, donor rollers can be made of an anodized or coated metal.

Figure 3:
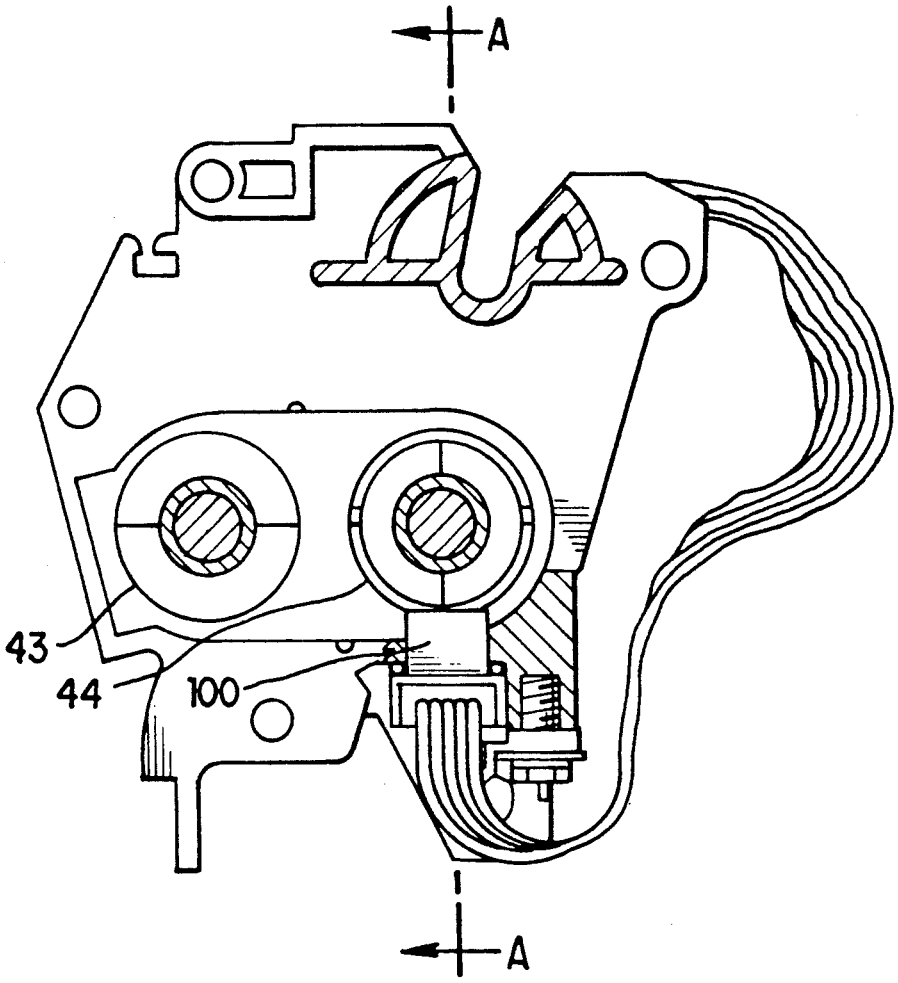
FIG. 3 is a schematic view of the developer sump with transport augers and toner concentration sensor.

As can be seen in FIG. 3, the two transport augers 43, 44 are located under opposite sides of the donor roll for mixing and transporting the toner and carrier particles. Though toner concentration sensor 100 is located below transport auger 44 in FIG. 3, the sensor can be located on other sides, and adjacent either transport auger. The auger can be, for example, helical or pseudo-type augers.

Figure 4:
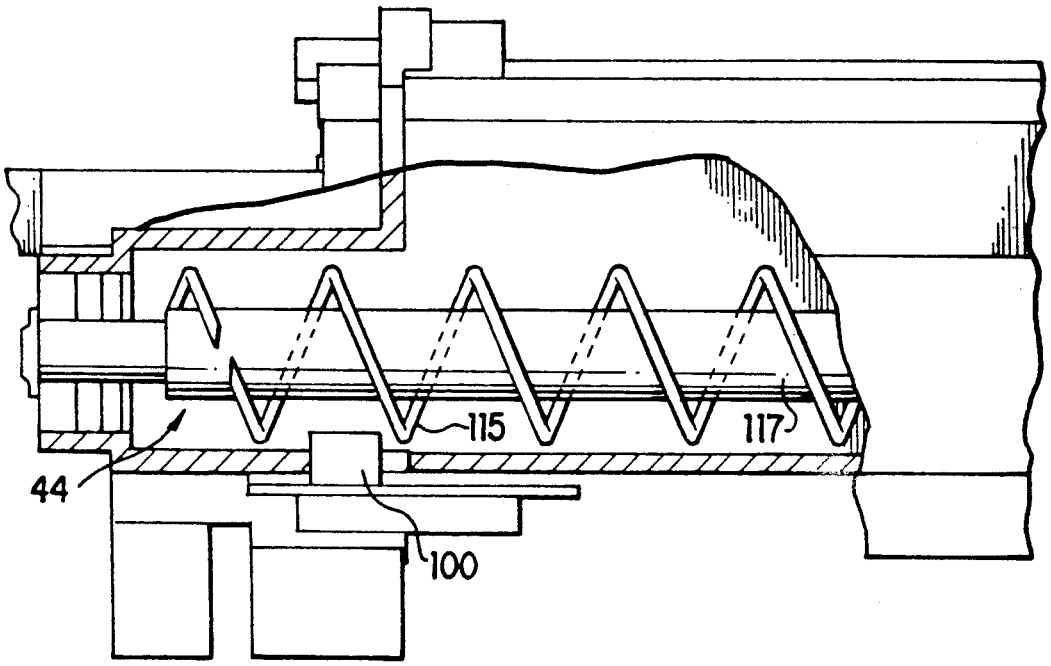
FIG. 4 is a side view, taken along line A—A of FIG. 3, of one of the two transport augers having the toner concentration sensor located therebelow.

As can be seen in FIG. 4 (taken along line A—A of FIG. 3), the toner concentration sensor 100 is not flush with the bottom of the chamber. The toner concentration sensor 100 projects from the bottom of the chamber towards the transport auger to ensure that actively flowing developer material is sensed by the sensor. Because material outside the diameter of the transport auger is not effectively transported, it is desirable to place the sensor surface within the auger diameter to enable the sensing of material actively transported.

Developer material most rapidly flows at locations radially inward along the auger (namely areas radially within the projection of the blade of the auger). It is desirable, therefore to project the sensor past the radially extending blade of the auger to overlap with the blade. In order to avoid contact between the rotating auger blade and the projecting sensor, a portion of the blade is notched in the area immediately adjacent the sensor to avoid such contact. The concentration sensor should be located towards the end of the transport auger which is away from the area where fresh toner is added to the mixing area to allow for proper mixing of toner and carrier and thus avoid an inaccurately high sensed toner concentration. In FIG. 4, the concentration sensor 100 is located toward the left end of the auger 44, such that new toner added to the mixing area would be added toward the right end of auger 44 in FIG. 4.

Figure 5:
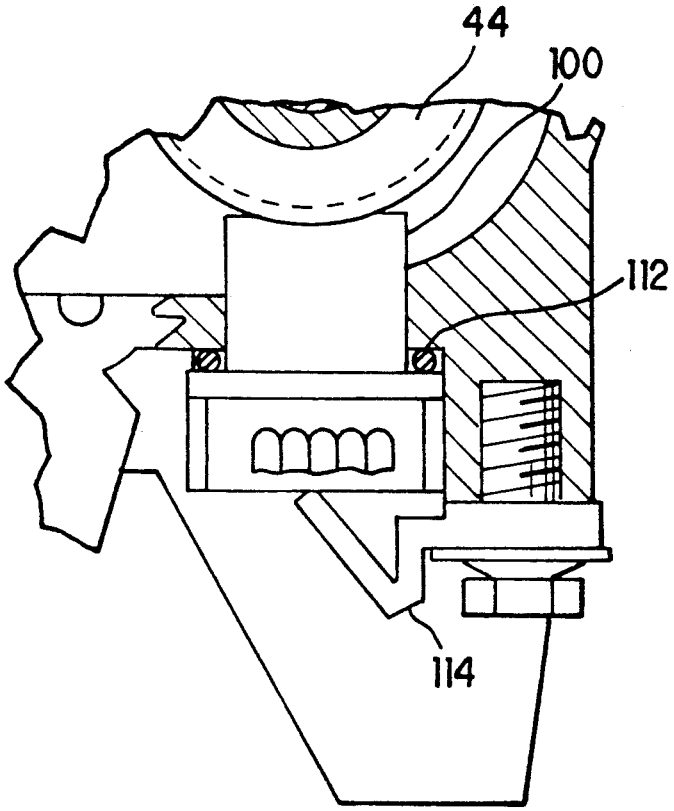
FIG. 5 is a schematic sectional view of the toner concentration sensor.

As can be seen in FIG. 5, the sensor 100 located under auger 44 is held in place by a gasket 112 and a plastic spring 114. The spring 114 provides a biasing force against the sensor 100 so that the sensor projects into the mixing area toward the auger 44.

Referring again to FIG. 4, the toner concentration sensor 100 projects into the mixing chamber to the extent that the sensor 100 overlaps with the auger blade 115 but does not touch auger core 117. The amount of overlap is from approximately 1 to 1.5 millimeters, and preferably about 1.16 millimeters. In order to avoid contact between the auger blade 115 and sensor 100 during rotation of the auger 44, the auger blade 115 must be partially filed or shaved to the extent that the blade will not contact the sensor during rotation of auger 44. The auger 44 can also be manufactured to have a blade portion which radially projects in one portion to a lesser extent (approximately 1.5 mm) from the central cylindrical portion of auger 44. The overlap of the sensor and auger blade ensures an active flow of developer material across the sensor and therefore improves the accuracy of the toner concentration readings of sensor 100.

The toner concentration sensor is preferably a TDK TS series toner concentration sensor, which is a device for analog measurement of developer toner concentration. Such a sensor detects the change in developer material permeability due to the concentration of the toner. The particular sensing element in the device is a transformer that is magnetically coupled to the developer material. Higher permeability material at the sensor surface results in a higher output signal, thus the output is inversely proportional to toner concentration. The signal detected by the sensor requires processing to extract the relevant toner concentration signal. The processing is required because the auger rotation produces an AC signal detected by the sensor. The control circuit 88 in FIG. 2 can be a peak detection circuit for processing the signal from sensor 100. The peak detection circuit extracts the signal peak (which corresponds to the developer material) from the valley of the signal (which corresponds to the auger). Peak detection can be done by a hardware circuit or by a software program. The result is used in the marking module process control algorithms.

The invention has been described in detail with particular reference to preferred embodiments thereof, but it will be understood that variations and modifications can be affected within the spirit and scope of the invention as described herein above and as defined in the appended claims.

What is claimed is:

1. A method for determining a concentration of toner particles within a two-component development printing machine in which two-component developer material comprises said toner particles and carrier granules in a reservoir, the toner particles being selectively attracted to a charged receptor surface, the method comprising the steps of:

moving said developer material in the reservoir by rotation of at least one auger therein, the auger comprising a core and a radially extending blade;

sensing an amount of toner particles in the reservoir with a sensor mounted adjacent to the at least one auger in the reservoir; and positioning the sensor in said reservoir to overlap with the radially extending blade of said auger, the blade having a notch to avoid contact with said sensor during rotation of said auger.

2. The method of claim 1, wherein said overlap is from about 1 to 1.5 mm.

3. The method of claim 2, wherein said overlap is 1.16 mm.

4. The method of claim 1, wherein said at least one transport auger comprises two augers, each auger for transporting developer material in an opposite direction from the other.

5. The method of claim 1, further comprising a step of dispensing toner from a toner dispenser into said reservoir, said toner dispenser positioned at a first longitudinal end of said at least one auger and said sensor disposed at a second longitudinal end of said at least one auger.

6. The method of claim 1, further comprising the step of filtering the signal sensed by said sensor to remove signal components not corresponding to the amount of toner particles.

7. The method of claim 6, wherein in said filtering step a signal corresponding to the rotation of said auger is filtered out.

8. The method of claim 1, wherein said sensor projects substantially adjacent to a point where said auger blade connects with said auger core, said sensor not contacting said auger core.

9. A developer mechanism for determining a concentration of toner particles within a two-component development printing machine in which two-component developer material comprises said toner particles and carrier granules in a reservoir, the toner particles being selectively attracted to a charged receptor surface, the developer mechanism comprising:

at least one auger rotatably mounted in the reservoir for moving the developer material, the auger comprising a core and a radially extending blade;

a sensor mounted in the reservoir adjacent the auger for sensing an amount of toner particles in the reservoir;

wherein said sensor is positioned to overlap with the radially extending blade of said auger, the blade having a notched portion above said sensor to avoid contact with said sensor during rotation of said auger.

10. The developer mechanism of claim 9, wherein overlap is from about 1 to 1.5 mm.

11. The developer mechanism of claim 10, wherein said overlap is 1.16 mm.

12. The developer mechanism of claim 9, wherein said at least one transport auger for mixing said developer material comprises two augers, each auger for transporting developer material in an opposite direction from the other.

13. The developer mechanism of claim 9, further comprising a toner dispenser for dispensing toner into said reservoir, said toner dispenser positioned at a first longitudinal end of said at least one auger and said sensor disposed at a second longitudinal end of said at least one auger.

14. The developer mechanism of claim 9, further comprising filtering means for filtering out signal components of a signal detected by said sensor, said signal components not corresponding to the amount of toner particles.

15. The developer mechanism of claim 14, wherein said filtering means comprises a peak detection circuit for filtering out a signal component from said signal corresponding tot he rotation of the auger.

16. The developer mechanism of claim 9, wherein said sensor projects substantially adjacent to a point where said auger blade connects with said auger core, said sensor not contacting said auger core.

* * * * *